252-103 AU 166 EX
12/30/80 OR 4,242,216

United States Patent [19]

Daugherty et al.

[11] 4,242,216

[45] Dec. 30, 1980

[54] STABILIZED DICHLORODIMETHYL HYDANTOIN

[75] Inventors: Denny E. Daugherty, West Chester; Edwin R. Loder; Gary L. Young, both of Cincinnati, all of Ohio

[73] Assignee: Chemed Corporation, Cincinnati, Ohio

[21] Appl. No.: 79,430

[22] Filed: Sep. 27, 1979

[51] Int. Cl.[3] ..... C11D 7/56; C11D 7/54

[52] U.S. Cl. ..... 252/103; 252/95; 252/99; 424/14; 424/128

[58] Field of Search ..... 252/174, 99, 103; 424/14, 128

[56] References Cited

U.S. PATENT DOCUMENTS

| | | | |
|---|---|---|---|
| 2,463,680 | 3/1949 | Corrigan | 252/174 X |
| 3,296,069 | 1/1967 | Kowalski | 424/14 |
| 3,306,858 | 2/1967 | Oberle | 252/103 X |
| 3,488,420 | 1/1970 | Keast et al. | 424/128 |
| 3,562,165 | 2/1971 | Alteiri | 252/174 X |

*Primary Examiner*—Mayer Weinblatt
*Attorney, Agent, or Firm*—Charles L. Harness

[57] ABSTRACT

Dichlorodimethyl hydantoin stabilized for use in alkaline detergent formulations by forming granules or briquettes of a minimum size and hardness.

3 Claims, No Drawings

STABILIZED DICHLORODIMETHYL HYDANTOIN

This invention is directed to a novel form of 1,3-dichloro-5,5-dimethyl hydantoin (herein, DDH) and its use in alkaline powder detergents for general cleaning and sanitizing purposes.

In a preferred aspect, the novel form of DDH is made by compacting ordinary commercial powdered DDH, followed by breaking up the compacted material into a specific screen size. It can also be compacted by briquetting. The novel form is substantially stable in contact with alkaline powdered detergent formulations. It is also considerably more stable in its use solutions than is the ordinary commercial powdered variety.

One disadvantage of ordinary commercial DDH is that prior to this invention it could not be stored in formulations of a highly alkaline character. This placed it at a disadvantage in use, since it had to be added separately at the point of use. It could not be formulated with usual commercial detergent formulations for dish machines or for laundry or cleaner-sanitizer use, because it tended to decompose on storage.

The crux of this invention is that by modifying the form of DDH, we have converted it into a form which is relatively stable on contact with caustic materials. This is true in solid storage as well as in use in aqueous solution, e.g., in the actual wash liquids in dish machines and in laundry machines.

To accomplish the necessary compacting of DDH, we prefer to use pressure rolls, as hereinafter described. However, alternate means of compacting are available, such as briquetting, or melting DDH on a chilled roll, followed by flaking and screening.

It is known to compact chlorinated cyanuric acid and/or its salts for controlled chlorine release. See U.S. Pat. Nos. 3,296,069 and 3,488,420. Also, the Bepex Corp., makers of the compacting equipment referred to in Example 1 below, have issued a descriptive sheet showing use of their equipment to make a compacted sheet of granulated bleach. However, so far as we know, we are the first to compact DDH, and we are the first to discover that using screened compacted DDH remains relatively stable in alkaline detergent compositions. The latter feature is quite surprising in view of the known instability of commercial DDH in the presence of alkali. In fact, a major supplier (BASF Wyandotte) warns in a DDH ("Halane") technical brochure, "Due to the possibility of a reaction, Halane should not be formulated with other strongly alkaline materials or the alkali carbonates such as caustic soda, sodium carbonate, sodium bicarbonate, or sodium sesquicarbonate." At another place the brochure states, " . . . caution is again urged not to compound Halane with compounds such as caustic soda, soda ash, and other hydrated salts." Nevertheless, our form of DDH can be used quite efficiently in such alkaline compositions.

The compacted and screened DDH of this invention is particularly useful in dry alkaline detergent formulations intended for storage, and also for use in their aqueous solutions, dispersions, or slurries. By "alkaline" is meant compositions on the basic side of the pH scale comprised of materials such as sodium or potassium hydroxide, carbonate, bicarbonate, silicate, or metasilicate. Such formulations provide a pH higher than 7.0 on mixing 1 g. of the formulation in 100 ml. water.

A typical alkaline detergent formulation using this invention falls within the following ranges:

0–50% Sodium Carbonate
0–50% Sodium Tripolyphosphate
0–90% Sodium Chloride and/or Sodium Sulfate
0–15% Sodium Metasilicate, Anhydrous
0–30% Sodium Hydroxide, Beads
0–5% Wetting Agent
0.1–90% DDH To state this another way, the formulation contains 0.1–90% wt.% DDH, the balance of 10–99.9% being made up from the other components in amounts within their respective ranges, with the proviso that there must be at least 10% alkaline compounds, e.g., one or more of sodium carbonate, tripoly-phosphate, metasilicate, or hydroxide.

By proper selection of ingredients the formulation may also be useful as a disinfectant, sanitizing cleanser, laundry bleach or detergent bleach upon addition of other conventional detergent additives.

The function of the individual components is conventionally understood to be as follows:

Sodium Chloride (NaCl)—A filler used as a bulking aid which makes it more convenient for user to avoid waste. Alternates could include sodium sulfate ($Na_2SO_4$) and/or sodium carbonate ($Na_2CO_3$).

Caustic Soda (NaOH)—A builder which provides a high pH and alkalinity to partially saponify the greases and fats. Alternates could include anhydrous sodium metasilicate ($Na_2SiO_3$) or the pentahydrate version or combinations of $NaOH/Na_2SiO_3$.

Sodium Tripolyphosphate ($Na_5P_3O_{10}$) —A builder used for water hardness control, soil suspension, and also provides excellent detergency. Alternates could include Tetrasodium Pyrophosphate ($Na_4P_2O_7.10H_2O$), Sodium Hexametaphosphate ($Na_6P_6O_{18}$), or Sodium Orthophosphate Dodecahydrate ($Na_3PO_4.12H_2O$). Non-phosphated formulations are also feasible by employing the use of Zeolites [$Na_{12}(AlO_2.SiO_2)_{12}\times H_2O$].

DDH, Dichlorodimethyl Hydantoin (1,3-Dichcloro 5,5-Dimethyl Hydantoin) —In dishmachines, provides destaining and cleaning of coffee cups, urns, tea pots, plastic ware, etc. In laundry use, provides uniform bleach source. Microbiocidal activity is provided to sanitizer and disinfectant cleaner formulations by the release of available chlorine from DDH in use in solution.

The product may or may not contain low foaming or defoaming surfactants such as Polytergent S-305-LF (linear alcohol alkoxylates), Pluronic L-61 and L-62 (polypropylene glycol ethylene oxide condensates).

EXAMPLE 1

Preparation of DDH

Commercial DDH was used, having a mesh analysis as follows:

| U.S. Mesh | Wt. % retained |
|---|---|
| 30 | less than 0.1 |
| 60 | 2–5 |
| 100 | 8–20 |
| 200 | 80–90 |
| 300 | 10–15 |

This material was fed into a pressure apparatus, known as "K-G Compacting Equipment", available commercially from Bepex Corp., Rosemont, Illinois. This particular apparatus was equipped with two corrugated meshing compacting rolls, six inches in diameter and 2 inches wide. The apparatus possessed a roll force capability up to 1000 tons. In our work, we used 36,738 psi across the face of the rolls. We recommend at least 20,000 psi compacting pressure. There is in effect no realistic upper limit. However, no advantage is achieved by compaction using pressures in excess of about 200,000 psi. Hence our operating range is about 1,000 to 200,000 psi, and even more preferably, about 30,000 to 40,000 psi.

The sheet resulting from this equipment is about 1/64–1/16 inches thick. This sheet is broken up and comminuted as below described. Our work has established that the range of particle sizes should be through 10 mesh and on 100 mesh, i.e., −10+100. The screen in U.S. screen. Within this range −12+60 is further preferred, and the fraction that has given the very best results is −12+20 mesh.

The compacted product from the Bepex compacter was comminuted in a Chilsonator comminutor with a rotor blade operating at 3600 RPM in Test No. 1 and at 1000 RPM in Test No. 2. This apparatus was operated so as to gently cut the compacted DDH sheets into particles small enough the fall through a 10-mesh screen. The respective two products were screened further, and the screen analyses were found to be:

| | Sieve Analyses | |
|---|---|---|
| Mesh | Test #1 % Retained | Test #2 % Retained |
| 12 | 0.0 | 0.0 |
| 20 | 5.21 | 15.81 |
| 30 | 10.52 | 18.13 |
| 40 | 12.05 | 14.82 |
| 50 | 12.46 | 12.85 |
| Pan | 47.29 | 38.39 |

Product in the pan was returned to the compactor. The preferred fraction was −12+30, which was 5.21% in Test No. 1 and 15.8% in Test No. 2.

All measurements are by weight, or by weight percent, unless otherwise specified.

EXAMPLE 2

The −12+20 mesh DDH was compared to powdered commercial DDH in both dry storage stability and by tracking the available chlorine during operation of an institutional type dishmachine. In both cases, the improvement of chlorine stability to a typical, highly alkaline product, such as those used for mechanical dishwashing, was significant using our −13+20 mesh DDH versus the powdered commercial DDH.

DRY STORAGE STABILITY

The following formulation was used to test dry storage stability:

30% Sodium Carbonate
33% Sodium Tripolyphosphate
10% Sodium Chloride
15% Sodium Metasilicate, Anhydrous
10% Sodium Hydroxide, Beads
2.0% DDH Samples of the aforesaid formulations containing powdered commercial DDH and the compacted DDH of this invention were tested at room temperature for dry storage evaluation. The product with −12+20 mesh DDH (this invention) lost no more than 2% available chlorine after ninety days, compared to a 45% loss of available chlorine in the product containing commercial powdered DDH. The stability tests involved comparing powdered, −12+20 and −20+60 mesh DDH as the chlorine sources in various alkaline powder dish detergent products. These products were then stored in one gallon polyethylene jugs. Periodically a 40 gram representative sample was taken of each product. From this one liter of a 4% dish detergent solution was made. Twenty-five ml aliquots of the 4% solutions were then titrated (together with 25 ml each of KI and 10% $H_2SO_4$ and several drops starch solution) against standard sodium thiosulfate, in the known way. The aforesaid 4% dish detergent was essentially that described under "Dry Storage Stability" above.

EXAMPLE 3

Chlorine Stability in Dishmachine Operation

The next evaluation was made by operation of the same two formulations of Example 2 on a Blakeslee dishmachine, with a one gallon per minute overflow, while tracking the available chlorine in the wash tank. Eight pounds of the formula of Example 2 using the compacted −12+20 mesh DDH of Example 1 were made and placed in the dispensing equipment for operation for 210 minutes. A similar control run was made with the same formulation, but using commercial powdered DDH. We found a significant improvement to available chlorine when using the formulation of our invention compared to powdered commercial DDH (the control); namely, our product gave a 61% improvement to available chlorine. Another evaluation was made from the same data by comparing the mean average available chlorine (ppm) for each formulation. The mean average available chlorine for our product was 32.75 ppm compared to 12.25 ppm mean average available chlorine for the control. Common practice dictates that a minimum of 15 ppm available chlorine is necessary for destaining of cups and general tableware. The difference, again, represents a 63% improvement to average available chlorine yield in using our product.

The Blakeslee dishmachine uses the following principle. An electrode in the wash tank measures the strength of the wash solution and transmits the signal to control head. If the concentration is low, power is supplied to a solenoid valve causing it to open and admit hot water into the detergent reservoir pan. The concentrated solution contained in the detergent reservoir pan is fed into the wash tank thus building up the solution strength. When the desired concentration level has been achieved the electrode signals the solenoid to close and stop further detergent addition. When the solution strength again falls below the predetermined level, the solenoid valve is again opened to correct the depletion.

EXAMPLE 4

Briquetting of Powdered Halane

Similar results can be obtained by briquetting commercial powdered DDH and grinding to the desired particle size. It may also be desirable to use the briquettes without granulation. Our test, for example, has found that in a closed dispensing system where forty-five to sixty-five pounds of a formula like that of Example 2 are to be dispensed, using DDH briquettes to replace powdered DDH, or other dry chlorine sources, there is a two fold benefit, namely, improved chlorine stability and controlled rate of chlorine release.

DDH briquettes can be made on any conventional briquetting machine capable of generating the required pressure, i.e., about 1000 to 100,000 psi.

For comparison, sixty-five pounds of the formula of Example 2 was made containing DDH briquettes (1" dia. × ½" thick) for running on a Blakeslee two staged dishmachine. The available chlorine was tracked throughout the operation, comparing available chlorine for the briquettes, vs. powder. An increase of 190% of available chlorine was obtained by using the briquettes rather than the powdered commercial product.

The briquitte size and hardness is determined by the rate of chlorine release desired and the desired life of the briquette. For machine dishwashing, the DDH should be briquetted at a minimum pressure of 20,000 psi. For other uses the desired rate of chlorine release may need to be more rapid, therefore, the briquette would have more surface area and/or void spaces within the briquette, resulting from lower briquetting pressure.

EXAMPLE 5

An experiment was made to compare compacted DDH screened to −12+20 mesh, with commercial uncompacted DDH which had been wet-agglomerated and screened to take the −12+20 mesh fraction. The stability of the latter with machine usage was relatively poor; in essence it offered only twice the available chlorine of powdered commercial DDH referred to at the beginning of Example 1 while compacted −12+20 mesh DDH offers three times as much. Thus the improved stability of our compacted DDH is not due merely to the selection of a particular particle size, but rather to particle hardness exemplified by the process of compaction as herein described.

We claim:

1. A dry alkaline powdered dishmachine detergent consisting essentially of:

0–50% Sodium carbonate
0–50% Sodium tripolyphosphate
0–90% Sodium chloride or sodium sulfate
0–15% Sodium metasilicate, anhydrous
0–30% Sodium hydroxide
0–5% Wetting agent
0.1–90% 1,3-dichloro-5,5-dimethylhydantoin with the proviso that the composition contains at least 10% of one or more alkaline compounds selected from the group consisting of sodium carbonate, tripolyphosphate, metasilicate, or hydroxide; the said hydantoin derivative consisting of praticles in the −10+100 mesh range, U.S. screen, compacted at a pressure in the range of about 1000 to 200,000 psi, whereby chlorine loss on storage for 90 days is not more than about 2%.

2. Detergent according to claim 1 in which the compaction pressure is about 30,000 to 40,000 psi.

3. Composition according to claim 1 consisting essentially of:

30% Sodium carbonate
33% Sodium tripolyphosphate
10% Sodium chloride
15% Sodium metasilicate
10% Sodium hydroxide
2.0% 1,3-dichloro-5,5-dimethylhydantoin

* * * * *